US006279455B1

(12) United States Patent
Kruse

(10) Patent No.: US 6,279,455 B1
(45) Date of Patent: Aug. 28, 2001

(54) METHOD AND APPARATUS FOR MAKING A TWO PIECE UNITARY PISTON

(75) Inventor: Brian K. Kruse, Lafayette, IN (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/335,317

(22) Filed: Jun. 17, 1999

Related U.S. Application Data

(63) Continuation-in-part of application No. 09/167,458, filed on Oct. 6, 1998.

(51) Int. Cl.[7] ..... F01B 31/08
(52) U.S. Cl. ..... 92/186; 92/231; 29/888.042
(58) Field of Search ..... 92/186, 231, 260; 123/193.6; 29/888.042, 888.047, 888.045

(56) References Cited

U.S. PATENT DOCUMENTS

| | | | | |
|---|---|---|---|---|
| 4,011,797 | | 3/1977 | Cornet | 92/186 |
| 4,581,983 | * | 4/1986 | Moebus | 92/186 |
| 4,727,795 | | 3/1988 | Murray et al. | 92/189 |
| 5,359,922 | * | 11/1994 | Martins Leites et al. | 92/189 |
| 5,645,028 | * | 7/1997 | Matsuoka et al. | 123/276 |
| 5,778,846 | | 7/1998 | Mielke | 123/193.6 |
| 6,032,619 | * | 3/2000 | Zhu et al. | 123/41.35 |

FOREIGN PATENT DOCUMENTS

2730120-A * 1/1979 (DE) .

* cited by examiner

*Primary Examiner*—Edward K. Look
*Assistant Examiner*—Thomas E. Lazo
(74) *Attorney, Agent, or Firm*—Larry G. Cain

(57) ABSTRACT

Past pistons have been susceptible to reduced longevity due to increased forces of combustion thereon during operating cycles of an engine. The present two piece unitary piston increases the longevity of pistons used with increased forces of combustion. For example, a head member has a bottom surface and a support surface. And, a skirt member defines an upper outer support surface and an upper inner support surface. The head member and the skirt member have a preestablished material strength being generally the same. The head member and the skirt member are joined at an interface of the bottom surface and the upper outer support surface and the interface of the support surface and the upper inner support surface respectively by a welding process. The force of combustion acting on the crown portion is resisted by the upper outer support surface being in contacting relationship with the bottom surface. Thus, the skirt member structure supports and resists the bending moment of the combustion forces on the head member.

42 Claims, 4 Drawing Sheets

METHOD AND APPARATUS FOR MAKING A TWO PIECE UNITARY PISTON

This application is a continuation-in-part of co-pending application Ser. No. 09/167,458, filed on Oct. 6, 1998.

TECHNICAL FIELD

This invention relates generally to an engine and more particularly to a method and apparatus for making a piston used in the engine.

BACKGROUND ART

The development of engines over the past few years have included increasing the horse power without increasing the displacement of the engine. To obtain the increased horsepower, it has been necessary to increase the combustion pressures within the combustion chamber which are transferred through the piston into the connecting rod and crankshaft.

Such increase in pressures have required the improvement of the integrity of the piston to withstand the increased stresses thereon. In the past and in many cases today, such pistons are made of aluminum or cast iron. Or, in some applications have used an articulated piston having a steel head and an aluminum skirt. Such an example is shown in U.S. Pat. No. 5,040,454 issued on Aug. 20, 1991 to Benny Ballheimer and Stephen G. Shoup.

As the pressures of engine designs increase, further requirements for the improvement of the integrity of the piston to withstand the increasing stresses thereon has become more apparent. As the pressures increase and consequently the stresses increase attempts have been made to resist, for example, bending stresses. One such example, is shown in U.S. Pat. No. 3,877,351 issued Apr. 15, 1975 to Eugen Barfiss. A ring zone of an upper part being made of steel and being supported by a lower part consisting of an aluminum alloy. The upper part and the lower part are joined by a bolted connection in a removable method of attachment. Additionally, U.S. Pat. No. 4,346,646 issued Aug. 31, 1982 to Jürgen Ellermann discloses a crown of steel being connected with a piston body of aluminum. An annular skirt supports the piston body. The crown and the piston body are joined by a bolted connection in a removable method of attachment.

Other piston assemblies are joined in a fixed manner such as by welding. For example, U.S. Pat. No. 5,359,922 issued Nov. 1, 1994 to Jose M. Martins Leites et al. discloses a method of manufacturing an articulated piston head wherein two portions are joined by friction welding. U.S. Pat. No. 5,245,752 issued Sep. 21, 1993 to Andre Lippai et al. discloses a two-piece piston having two portions friction welded together, U.S. Pat. No. 4,286,505 issued Sep. 1, 1981 to John K. Amdall discloses a two piece piston being joined by a brazing process, and U.S. Pat. No. 3,974,381 issued Aug. 10, 1976 to Manfred Rohrle et al. discloses a method of welding a workpiece including an electron beam welding.

However, in many applications, the complexity of the piston design increases the cost of manufacturing. For example, with some welded designs flash occurs which can separate and contaminate the lubricating and cooling liquid. Additionally, some welds cause a stress riser in an undesired location resulting in a failed piston. And, with some bolted joints, additional strength is required at the bolted joint requiring additional parts and assembly time.

The present invention is directed to overcoming one or more of the problems as set forth above.

DISCLOSURE OF THE INVENTION

In one aspect of the invention a two piece unitary piston is comprised of a head member being made of a material having a preestablished material strength, has a bottom surface and an inner support portion defining a support surface. A skirt member is made of a material having a preestablished material strength being substantially the same as the preestablished material strength of said head member. The head member has an upper outer support surface being aligned with the bottom surface forming an interface. And, an inner support portion defines an upper inner support surface forming an interface. Each of the interfaces is in contacting and supporting relationship with the support surface and the bottom surface of the head member respectively. The interface formed by the upper inner support surface being aligned with the support surface is joined by a welding process. The interface formed by said upper outer support surface being aligned with said bottom surface is joined by the welding process. And a piston cooling gallery is formed by the upper inner support surface and the support surface interface and the upper outer support surface being aligned with the bottom surface interface.

In another aspect of the invention a method of making a two piece unitary piston is comprised the following steps. Forming a head member of a material having a preestablished strength, the forming defining a bottom surface and a support surface being spaced from said bottom surface. Forming a skirt member of a material having a preestablished strength being substantially the same as the preestablished material of the head member, the forming defining an upper outer support surface and an upper inner support surface being spaced from said upper outer support surface. Positioning the bottom surface of the head member in contacting and supporting relationship with the upper outer support surface of the skirt member. Positioning the support surface of the head member in contacting and supporting relationship with the upper inner support surface of the skirt member. Welding the interface of the bottom surface and the upper outer support surface. Welding the interface of the support surface and the upper inner support surface. Combining fixedly the head member and the skirt member forming a piston cooling gallery.

BEST MODE FOR CARRYING OUT THE INVENTION

Figure 1:
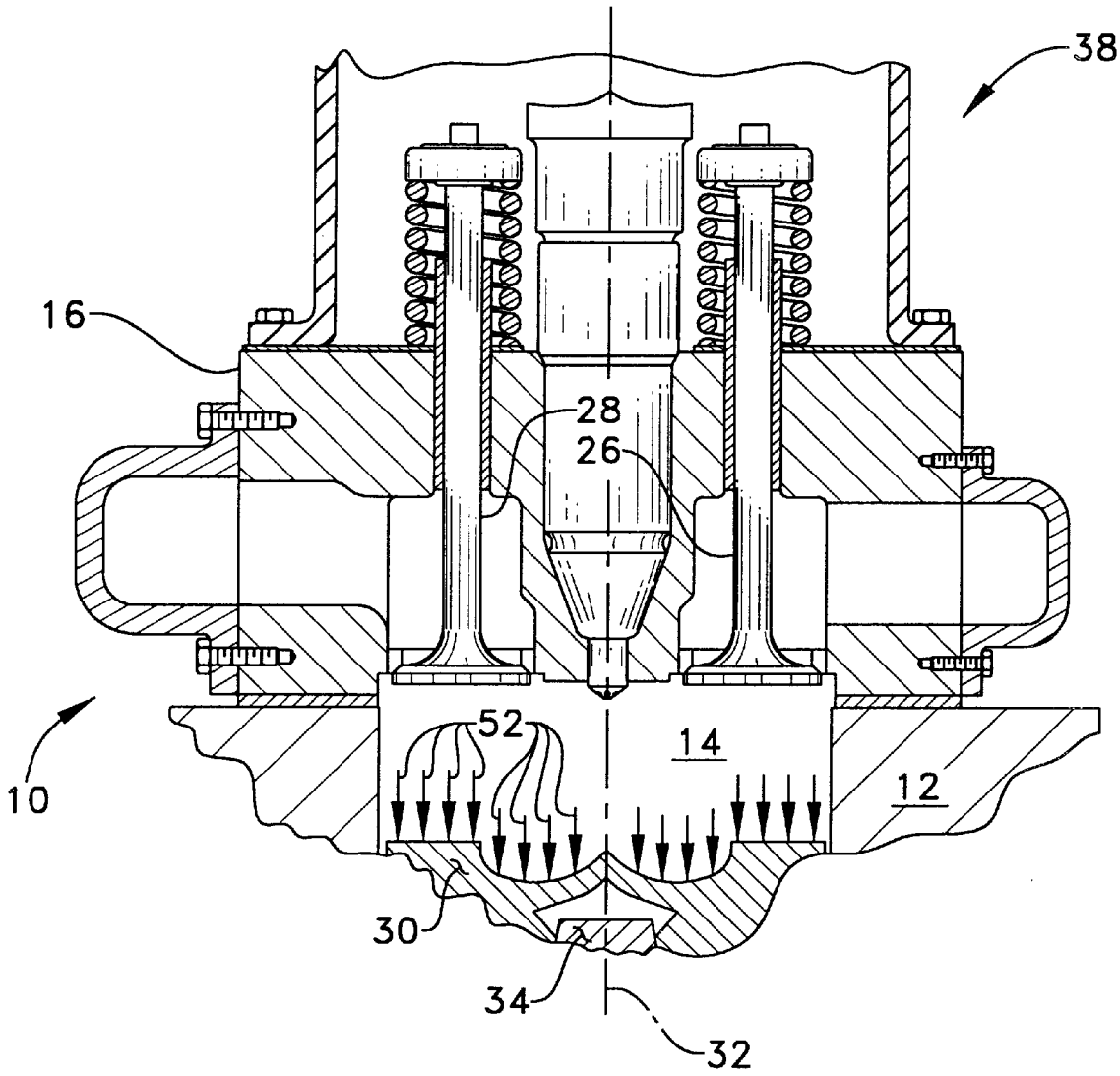
FIG. 1 is a partially sectioned view of an engine embodying the present invention.

Referring to FIG. 1, an engine 10 includes a block 12 having a plurality of cylinders 14 therein, of which only one is shown, and a head 16 is attached to the block 12. The head 16 is of conventional construction and includes a pair of intake valve 26 operatively communicating with the respective one of the plurality of cylinders 14. And, a pair of exhaust valves 28 operatively communicate with the respective one of the plurality of cylinders 14.

Figure 2:
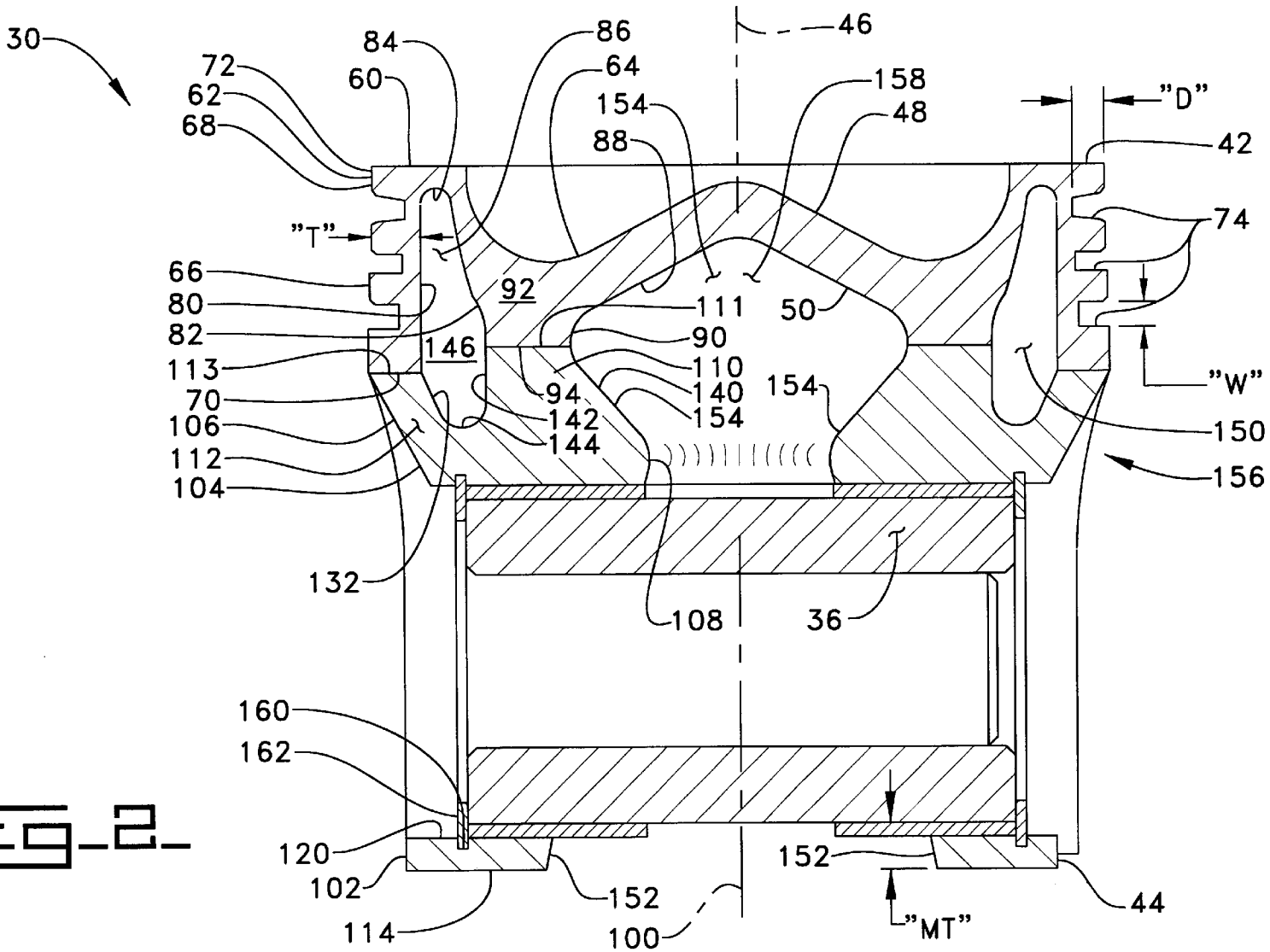
FIG. 2 is sectional view of a two piece unitary piston.

Positioned in each of the plurality of cylinders 14 is a two piece unitary piston 30 defining an axis 32. A connecting rod 34 is attached to the two piece unitary piston 30 in a convention manner by a wrist pin 36, as shown in FIG. 2. A conventional fuel system 38 operatively communicates with the respective cylinder 14 in a convention manner.

The two piece unitary piston 30, as is further shown in FIG. 2, includes a first piece or head member 42 being fixedly attached to a second piece or skirt member 44. The head member 42 is made of a steel forging or casting having a preestablished structural strength and/or grain flow. The head member 42 has a generally cylindrical configuration having an axis 46 being synonymous with the axis 32 of the two piece unitary piston 30. The head member 42 defines a combustion side 48 and a cooling side 50 being spaced from the combustion side 48 a preestablished distance. As shown in FIG. 1, the combustion side 48 has a force of combustion, represented by the arrows 52, applied thereto. The combustion side 48 defines a crown portion 60 located radially near an extremity 62 of the head member 42. Located radially inward from the crown portion 60 is a crater portion 64 which in this application has a Mexican hat design or configuration. Extending axially from the crown portion 60 a preestablished distance is a ring band portion 66 having a preestablished thickness designated as "T". The ring band portion 66 defines a land surface 68 extending from the crown portion 60 and terminating at a lower extremity or bottom surface 70. The bottom surface 70 has a preestablished surface area and a preestablished angular relationship to the axis 46. As shown in FIG. 2, the bottom surface 70 is at about an angle of 90 degrees to the axis 46. Positioned along the ring band portion 66 and extending a preestablished distance from the crown portion 60 toward the bottom surface 70 is a top land 72. Extending axially along the ring band portion 66 from the top land 72 toward the bottom surface 70, in a respective order, is a plurality of ring grooves 74. The plurality of ring grooves 74 define a preestablished width "W" and a preestablished depth "D". The preestablished width "W" and the preestablished depth "D" for each individual one of the plurality of grooves 74 can vary in size.

The cooling side 50 includes a ring band cooling surface 80 being radially spaced inwardly from the land surface 68 and forms the inner extremity of the thickness "T". The ring band cooling surface 80 extends upwardly from the bottom surface 70 toward the crown portion 60 a preestablished distance. Spaced radially inwardly from the ring band cooling surface 80 is an outer support cooling surface 82. The outer support cooling surface 82 is spaced from the crown portion 60 a preestablished distance and extends downwardly therefrom. An upper arcuate cooling surface 84 connects the uppermost ends of the ring band cooling surface 80 and the outer support cooling surface 82. The upper arcuate cooling surface 84 is spaced from the crown portion 60 a preestablished distance. A head member cooling gallery 86 is formed by the ring band cooling surface 80, the upper arcuate cooling surface 84 and the outer support cooling surface 82. The head member cooling gallery 86 defines a width being interposed at the greatest distance between the ring band cooling surface 80 and the outer support cooling surface 82. At the lower extremity of the head member cooling gallery 86, a substantial width of the head member cooling gallery 86 is open or available for a machine tool to enter. For example, at least an excess of 50 percent of the width is open or available for entrance of the machine tool. Ideally, the upper most part of the head member cooling gallery 86 is above or at a height equal to the position of the top ring groove of the plurality of ring grooves 74.

Spaced from the combustion side 48 a preestablished distance is a crater side cooling surface 88. A portion of the crater side cooling surface 88 is generally spaced an equal distance from the crater portion 64 and defines a generally frustoconical configuration. The crater side cooling surface 88 terminated at a radial distance from the axis 46 at an inner support cooling surface 90 of an inner support portion 92. The inner support cooling surface 90 is spaced from the outer support cooling surface 82 and is connected by a support surface 94 having a preestablished surface area and a preestablished angular relationship to the axis 46. As shown in FIG. 2, the support surface 94 is at about a 90 degree angle to the axis 46.

The skirt member 44 is made of a steel forging or a casting and defines a preestablished structural strength and/or grain flow. The structural strength of the head member 42 and the skirt member 44 are substantially the same. The skirt member 44 has a generally cylindrical configuration and defines an axis 100 being synonymous with the axis 32 of the two piece unitary piston 30 and the axis 46 of the head member 42. The skirt member 44 includes a strut portion 102 and a base portion 104. The skirt member 44 is defined by an outer extremity 106, an inner extremity 108 having a generally frustoconical configuration with a flattened peak or top. The skirt member 44 further includes an inner support portion 110 defining an upper inner support surface 111, an outer support portion 112 defining an upper outer support surface 113 and a lower surface 114.

The base portion 104 extends from the upper most extremity of the inner support portion 110, the upper inner support surface 111, and the outer support portion 112, the upper outer support surface 113, toward the lower surface 114 a preestablished distance defined by an upper extremity of a radius of a bore 120 extending within the outer extremity 106 of the skirt member 44. The bore 120 is perpendicular to the axis 32 of the two piece unitary piston 30, the axis 46 of the head member 42 and the axis 100 of the skirt member 44.

The upper outer support surface 113 of the outer support portion 112 has a preestablished surface area and a preestablished angular relationship to the axis 100. As shown in FIG. 2, the angular relationship of the upper outer support surface 113 to the axis 100 is about a ninety (90) degree angle. The upper support surface 113 extends inwardly from the outer extremity 106 of the skirt member 44 a preestablished distance. The upper outer support surface 113 has a starting point being generally aligned with the ring band cooling surface 80 of the head member 42. And, the upper outer support surface 113 has an ending point being generally aligned with the land surface 68 of the head member 42. An outer support portion cooling surface 132 extends downwardly from the starting point toward the lower surface 114 a preestablished distance.

The upper inner support surface 111 of the inner support portion 110 has a preestablished surface area and a preestablished angular relationship to the axis 100. As shown in FIG. 2, the angular relationship of the upper inner support surface 111 to the axis 100 is about a ninety (90) degree angle. The upper inner support surface 111 extends radially outwardly from the axis 100 of the skirt member 44 a preestablished distance. The upper inner support surface 111 has a starting point being generally aligned with the inner support cooling surface 90 of the head member 42. And, has an ending point being generally aligned with the outer support cooling surface 82 of the head member 42. A first inner support portion cooling surface 140 extends downwardly from the starting point at an angle to the upper inner support surface 111 and terminates at the inner periphery 108. And a second inner support cooling surface 142 extends downwardly from the ending point of the upper inner support surface 111 a preestablished distance toward the lower surface 114. A lower arcuate cooling surface 144 connects the second inner support cooling surface 142 and the outer support portion cooling surface 132. The second inner support cooling surface 142, the outer support portion cooling surface 132 and the arcuate cooling surface 144 form a skirt member cooling gallery 146. The head member cooling gallery 86 and the skirt member cooling gallery 146 form a piston cooling gallery 150. As an alternative, the piston cooling gallery 150 could be located totally within one of the head member 42 or the skirt member 44.

The strut portion 102 extends from the lower surface 114 to a predetermined distance defined by the upper extremity of the radius of the bore 120. The bore 120 is positioned in the strut portion 102 of the skirt member 44 and defines a preestablished material thickness designated as "MT". "MT" is defined between the lower surface 114 and the radius of the bore 120. The inner extremity 108, with the strut portion 102 and the base portion 104 connected extends from the lower surface 114 upwardly past the thickness "MT", through the bore 120, and exits near the crater underside cooling surface 88. The inner extremity 108 is defined by a pair of tapered sides 152. The tapered sides 152 are perpendicular to the axis of the bore 120 and are at an angle to the axis 32 of the two piece unitary piston 30, thus, forming the taper. A pair of radiused portions 154 connected the respective tapered sides 152 and define the remainder of the inner extremity 108. The pair of radiused portions 154 intersect with the piston cooling gallery 150 and define a coolant inlet 156 and a coolant outlet 158 at a position being generally perpendicular to the wrist pin 36. A snap ring groove 160, having a preestablished thickness and depth, is positioned in each end of the bore 120. And, a snap ring 162 is removably positioned in the snap ring groove 160.

The head member 42 is formed from steel by preferably a forging process or, as an alternative, a casting process in a conventional manner. A portion of the head member 42 features, such as, the ring band portion 66, the bottom surface 70, the rough cut plurality of ring grooves 74, inner support portion 92, and the head ring cooling gallery 86 are premachined. And, the skirt member 44 is formed from steel by preferably a forging process or a casting process in a conventional manner. A portion of the skirt member 44 features, such as, the inner support portion 110, the outer support portion 112, the skirt member cooling gallery 146 and the bore 120 are premachined. Thus, the head member 42 and the skirt member 44 are ready to be assembled to form the two piece unitary piston 30. Initially, the bottom surface 70 of the ring band portion 66 and the support surface 94 of the inner support portion 92 of the head member 42 are positioned in respective alignment with the upper outer support surface 113 of the outer support portion 112 and the upper inner support surface 111 of the inner support portion 110 of the skirt member 44. For example, the bottom surface 70 of the head member 42 is aligned with the upper outer support surface 113 of the skirt member 44, and the support surface 94 of the head member 42 is aligned with the upper inner support surface 111 of the skirt member 44. Thus, the bottom surface 70 of the head member 42 is in contacting and supporting relationship with the upper outer support surface 113 of the skirt member 44. And, the support surface 94 of the head member 42 is in contacting and supporting relationship with the upper inner support surface 111 of the skirt member 44. At this time, the interface between the bottom surface 70 of the head member 42 and the upper outer support surface 113 of the skirt member 44 are fixedly connected by a welding process 170. And, the interface between the support surface 94 of the head member 42 and the upper inner support surface 111 of the skirt member 44 are fixedly connected by the welding process 170. In this application, the welding process 170 of preference is defined to be a CO2 laser weld 172. However alternative welds or processes could be use without changing the jest of the invention. Such welding processes including friction welding or inertia welding, brazing or electron beam. Thus, the formation of the two piece unitary piston 30 is completed. And, after the welding step, the resulting two piece unitary piston 30 is finish machined in a conventional manner.

It should be understood that the position and location of the bottom surface 70 on the head member 42 and the respective upper outer support surface 113 on the skirt member 44 can be varied without changing the essence of the invention. Additionally, the position and location of the support surface 94 on the head member 42 and the respective upper inner support surface 111 on the skirt member 44 can be varied without changing the essence of the invention. Furthermore, the axial relationship of the bottom surface 70 and the support surface 94 on the head member 42 relative to the upper outer support surface 113 and the upper inner support surface 111 on the skirt member 44 can be varied without changing the essence of the invention.

Figure 3:
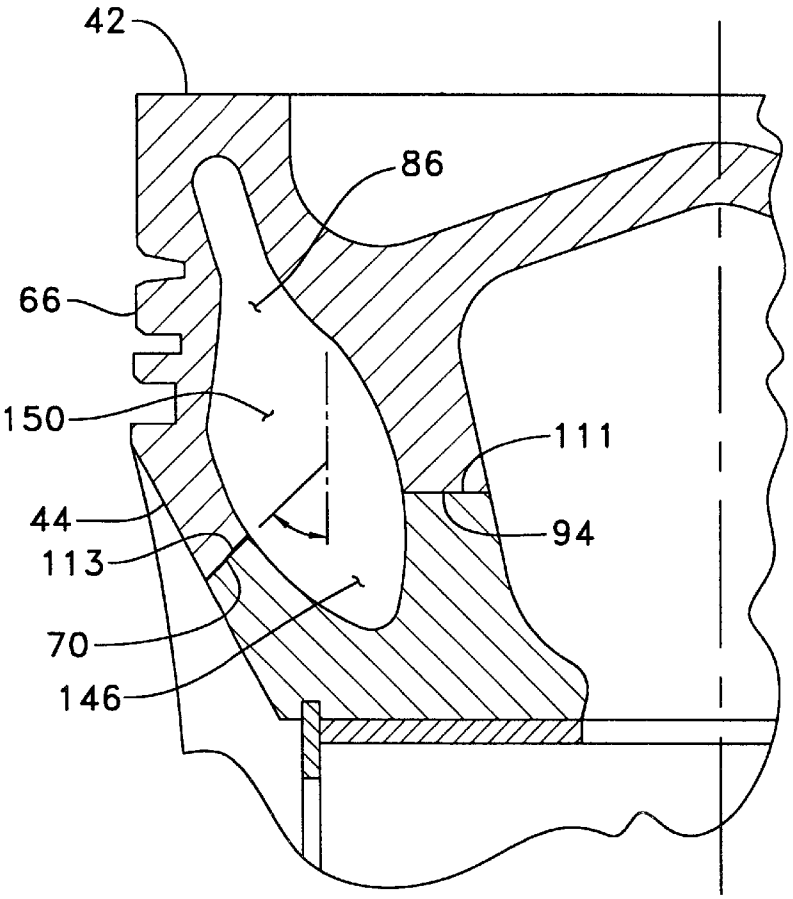
FIG. 3 is a partial view of an alternate configuration of the two piece unitary piston.

For example, as best shown in FIGS. 3, 4, 5 and 6, alternative configurations of the two piece unitary piston 30 are shown. In FIG. 3, the interface of the bottom surface 70 on the head member 42 and the upper outer support surface 113 on the skirt member 44 are radially and axially varied from that shown in FIG. 2. For example, the ring band portion 66 has been extended axially closer to the bore 120 and radially closer to the axis 32. Additionally, the preestablished surface area of the intersection of the bottom surface 70 and the upper outer support surface 113, and the support surface 94 and the upper inner support surface 111 is smaller. Furthermore, the preestablished angular relationship to the axis 46 and 100 has been biased to the axis 46 and 100 at an angle other than ninety (90) degrees. For example, the angular relationship has been changed to about a forty-five (45) degree angle at the intersection of the bottom surface 70 and the upper outer support surface 113. Whereas, the intersection of the support surface 94 and the upper inner support surface 111 remains at about the ninety (90) degrees. And, the support surface 94 on the head member 42 and the upper inner support surface 111 on the skirt member 44 have a different interface. For example, the preestablished surface area had been decreased, and the axial location thereof is closer to the bore 120.

Figure 4:
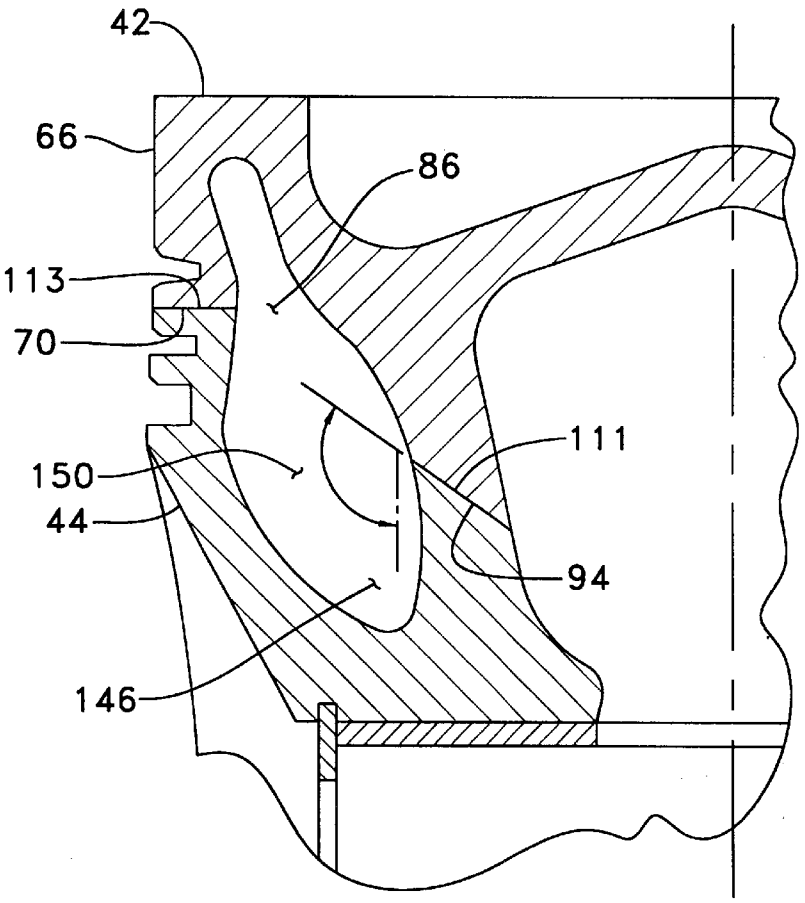
FIG. 4 is a partial view of an alternate configuration of the two piece unitary piston.

In FIG. 4, the interface of the bottom surface 70 on the head member 42 and the upper outer support surface 113 on the skirt member 44 are axially varied from that shown in FIGS. 2 and 3. For example, the length of the ring band portion 66 has been reduced and is axially further from the bore 120. Furthermore, a portion of the plurality of ring grooves 74 have been moved from the head member 42 to the skirt member 44. And, the support surface 94 on the head member 42 and the upper inner support surface 111 on the skirt member 44 have a different interface. For example, the preestablished surface area has been decreased, and the axial location thereof is closer to the bore 120. Additionally, the preestablished angular relationship to the axis 46 and 100 has been changed to about a one hundred and thirty-five (135) degree angle at the intersection of the support surface 94 and the upper inner support surface 111 whereas the intersection of the bottom surface 70 and the upper outer support surface 113 remains at about the ninety (90) degrees.

Figure 5:
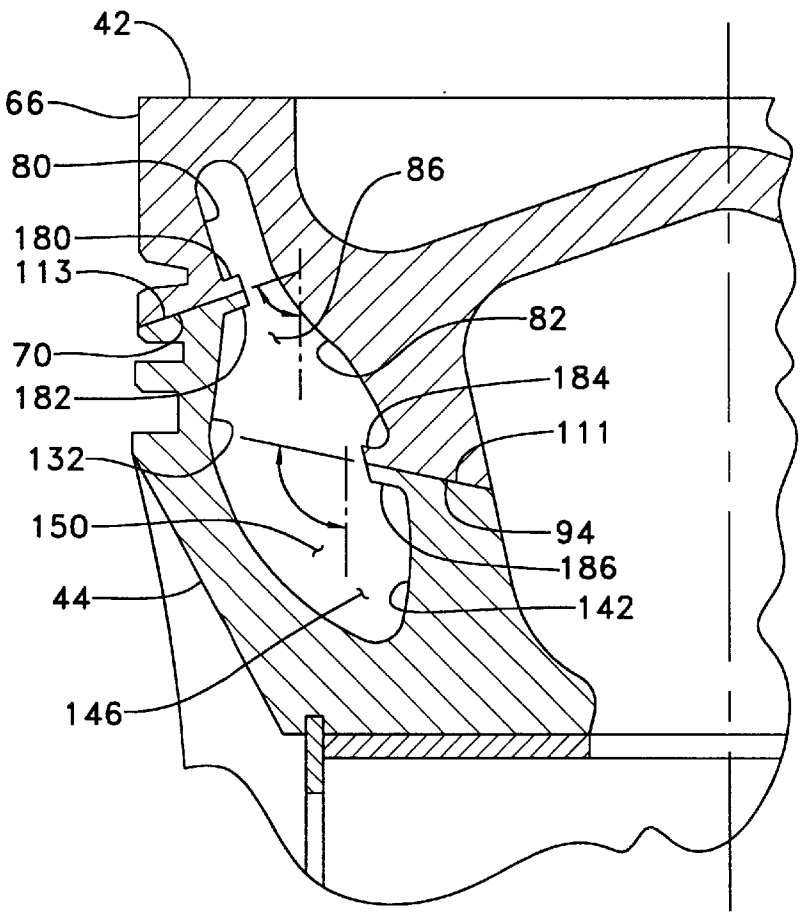
FIG. 5 is a partial view of an alternate configuration of the two piece unitary piston.

In FIG. 5, the interface of the bottom surface 70 on the head member 42 and the upper outer support surface 113 on the skirt member 44 are radially and axially varied from that shown in FIGS. 2, 3 and 4. For example, the length of the ring band portion 66 has been reduced and is axially further from the bore 120. Furthermore, a portion of the plurality of ring grooves 74 have been moved from the head member 42 to the skirt member 44. And, the preestablished angular relationship of the interface to the axis 46 and 100 has been changed to about a seventy-five (75) degree angle at the intersection of the bottom surface 70 and the upper outer support surface 113. Whereas, the intersection of the support surface 94 and the upper inner support surface 111 is at about a one hundred and five (105) degree angle. Additionally, a first protrusion 180 has been added to the ring band cooling surface 80 of the head member 42 and a second protrusion 182 has been added to the outer support portion cooling surface 132 of the skirt member 44. Thus, the preestablished surface area is larger. And, the support surface 94 on the head member 42 and the upper inner support surface 111 on the skirt member 44 have a different interface. Additionally, a third protrusion 184 is added to the outer support cooling surface 82 of the inner support portion 92 of the head member 42. And, a fourth protrusion 186 is added to the second inner support cooling surface 142 of the inner support portion 110 of the skirt member 44. Thus, the preestablished surface area is larger.

Figure 6:
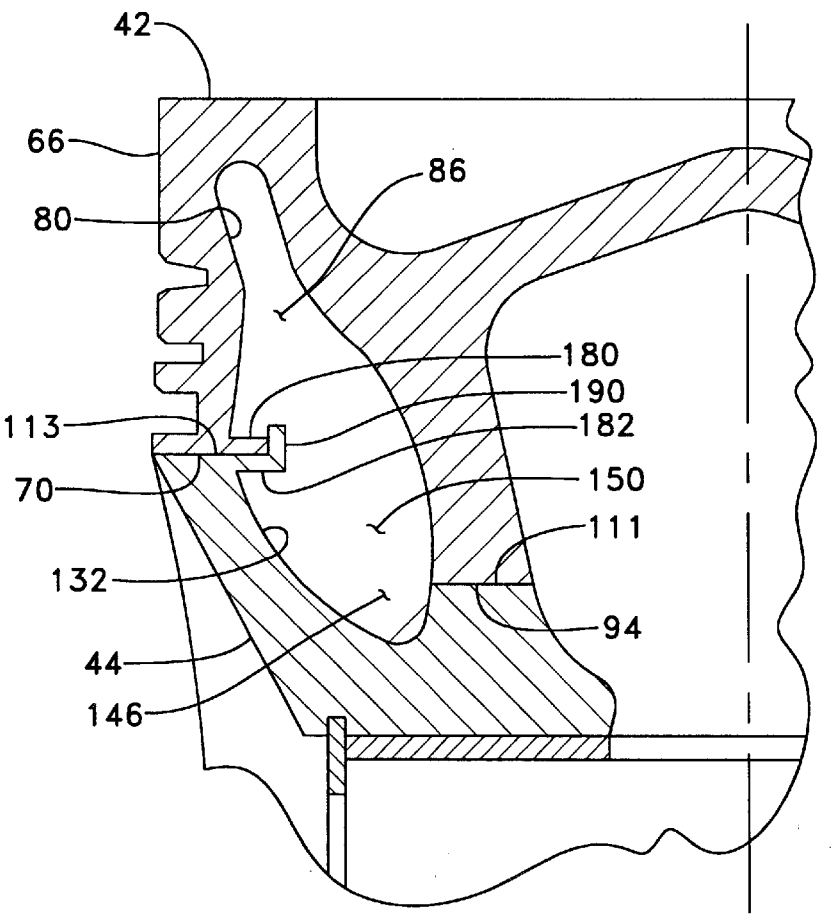
FIG. 6 is a partial view of an alternate configuration of the two piece unitary piston.

In FIG. 6, the interface of the bottom surface 70 on the head member 42 and the upper outer support surface 113 on the skirt member 44 are radially and axially similar to that shown in FIG. 2. However, the first protrusion 180 has been added to the ring band cooling surface 80 of the head member 42 and the second protrusion 182 has been added to the outer support portion cooling surface 132 of the skirt member 44. The second protrusion 182 has been further modified. For example, a lip 190 is added to the second protrusion 182 and radially encloses the first protrusion 180. A portion of the lip 190 extends axially above the first protrusion 182. Additionally, the support surface 94 on the head member 42 and the upper inner support surface 111 on the skirt member 44 have a different interface. For example, the interface is positioned axially closer to the bore 120 as compared to that shown in FIG. 2.

Other combinations and variation of the preestablished angular relationship and preestablished surface area of the interfaces can be used without changing the essence of the invention. For example, one or each of the interfaces can have the angular relationship varied and one of each of the interfaces can have the surface area varied.

INDUSTRIAL APPLICABILITY

In use, the engine 10 is started. Combustion occurs and the two piece unitary piston 30 has the force applied thereon and the stresses applied thereto. For example, as illustrated in FIG. 1, and shown by the arrows 52, the force causing the stress is shown. As is shown, a force is applied to the crown portion 60. With the inner support portion 110 of the skirt member 44 being in contacting and supporting relationship with the inner support portion 92 of the head member 42 forces applied to the head member 42 are transferred through the base portion 104 to the wrist pin 36 and the connecting rod 34. Additional force results in a moment about the axis 32. With the supporting structure of the skirt member 44 having substantially the same structural strength as the head member 42 and the upper outer support surface 113 of the skirt member 44 being in contacting and supporting relationship with the bottom surface 70 of the head member 42 any moment about the axis 32 is resisted. Thus, the structural integrity of the two piece unitary piston 30 is improved and results in increased life, longevity and decreased down time.

Additionally, with the construction of the head member 42, the preestablished thickness "T" of the ring band portion 66 is easily accessible for machining. A substantial width of the head member cooling gallery 86 is open or available for a machine tool to enter. As stated earlier, at least an excess of 50 percent of the width is open or available for entrance of the machine tool. Thus, as the lubricating and cooling oil enters the piston cooling gallery 150 through the coolant inlet 156 the lubricating and cooling oil is distributed along the ring band cooling surface 80. With the preestablished thickness "T" being controlled the ring band portion 66, in which the plurality of rings 74 are positioned, is appropriately cooled. For example, as the two piece unitary piston 30 moves axially the lubricant and coolant trapped within the piston cooling gallery 150 is shaken along the ring band cooling surface 80. The lubricant and coolant travels along the upper arcuate cooling surface 84 and the outer support cooling surface 82 of the head member cooling gallery 86. And the lubricant and coolant also travels along the second inner support cooling surface 142, the lower arcuate cooling surface 144 and the outer support portion cooling surface 132 of the skirt member cooling gallery 146. Thus, the life of the two piece unitary piston 30 is increased. After cooling the ring band portion 66, the hot oil escapes from the piston oil cooling gallery 150 through the coolant outlet 158 and is recirculated in a conventional manner.

Addition lubricant and coolant is directed along the crater side cooling surface 88 and with the first inner support portion cooling surface 140 being at an angle to the upper inner support surface 111, lubricant and coolant is directed to the interface of the wrist pin 36 and the connecting rod 34. For example, the lubricant and coolant is directed along the frustoconical configuration of the crater side cooling surface 88, falls therefrom and strikes the first inner support portion cooling surface 140. From the first inner support portion cooling surface 140 the lubricant and coolant is directed to the interface of the wrist pin 36 and the connecting rod 34. Thus, the flow of lubricant is improved with the structural configuration of the two piece unitary piston 30.

The two piece unitary piston 30 is easily manufactured. For example, the structural configuration of the head member 42 and the skirt member 44 can be easily rough and finished machined. The structural integrity is improved with the use of materials having the same structural integrity. Bending forces are resisted and increased life is made available with the structural configuration of the two piece unitary piston 30 welded structure.

The alternatives as shown add various benefits to the structure of the two piece unitary piston 30. For example, as shown in FIG. 3, the weld area is positioned away from the ring band portion 66 and away from the plurality of ring grooves 74. The alternative configuration of FIG. 4 provides a weld within the ring support area which is contemplated to increase the wear resistance within the associated ring groove 74. The alternative configuration of FIG. 5 is contemplated to increase the cooling enhancement of the piston cooling gallery 150. And the alternative configuration of FIG. 6 is contemplated to reduce the stress within the welded area by providing a backing which ends the weld in a non-highly stress area.

As a further alternative, the head member 42 and the skirt member 44 can be forged as a single unit and after forging, the single unit is cut or separated into the head member 42 and the skirt member 44. Thus, the forging of the piston cooling gallery 150 can have a very simple configuration or as an alternative be void of the piston cooling gallery 150 entirely. With the single unit, the head member 42 and the skirt member 44 are formed by sawing the single unit and the piston cooling gallery 150, the plurality of ring grooves 74 and the crater portion 64 are machined prior to welding and, if necessary, final machined after welding.

Other aspects, objects and advantages of this invention can be obtained from a study of the drawings, the disclosure and the appended claims.

What is claimed is:

1. A two piece unitary piston, said two piece unitary piston defining an axis and comprising:

a head member being made of a material having a preestablished material strength, having a bottom surface and an inner support portion defining a support surface;

a skirt member being made of a material having a preestablished material strength being substantially the same as the preestablished material strength of said head member, having an upper outer support surface aligned with the bottom surface forming an interface and an inner support portion defining an upper inner support surface forming an interface and each of said interfaces being in contacting and supporting relationship with said bottom surface and said support surface of said head member respectively;

at least one of said interface of said bottom surface and said upper outer support surface and said interface of said support surface and said upper inner support surface being oriented at an angle other than 90 degrees to said axis;

said interface formed by said upper inner support surface being aligned with said support surface being joined by a welding process;

said interface formed by said upper outer support surface being aligned with said bottom surface being joined by said welding process; and a piston cooling gallery being formed by said upper inner support surface and said support surface interface and said upper outer support surface being aligned with said bottom surface interface.

2. The two piece unitary piston of claim 1 wherein each of said head member and said skirt member are made of steel.

3. The two piece unitary piston of claim 2 wherein each of said head member and said skirt member are formed as a forging.

4. The two piece unitary piston of claim 2 wherein said head member is formed as a forging and said skirt member is formed as a casting.

5. The two piece unitary piston of claim 2 wherein said head member is formed as a casting and said skirt member is formed as a forging.

6. The two piece unitary piston of claim 1 wherein said head member defines a combustion side and said interface of said support surface of said head member and said upper inner support surface of said skirt member being closer thereto than said interface of said bottom surface and said upper outer support surface.

7. The two piece unitary piston of claim 1 wherein said head member defines a combustion side and said interface of said bottom surface and said upper outer support surface of said skirt member being closer thereto than said interface of said support surface and said upper inner support surface.

8. The two piece unitary piston of claim 1 wherein at least one of said interface of said bottom surface and said upper outer support surface and said interface of said support surface and said upper inner support surface being biased at a ninety degree angle to said axis.

9. The two piece unitary piston of claim 1 wherein said head member includes a head member cooling gallery.

10. The two piece unitary piston of claim 9 wherein said head member cooling gallery defines a width and at a lower extremity of said head member cooling gallery a substantial width of said head member cooling gallery being open.

11. The two piece unitary piston of claim 10 wherein at least an excess of fifty percent of said width being open at said lower extremity.

12. The two piece unitary piston of claim 1 wherein said skirt member includes a skirt member cooling gallery.

13. The two piece unitary piston of claim 12 wherein said skirt member cooling gallery defines a width and at a lower extremity of said skirt member cooling gallery a substantial width of said skirt member cooling gallery being open.

14. The two piece unitary piston of claim 1 wherein said piston cooling gallery has a protrusion therein.

15. The two piece unitary piston of claim 14 wherein said protrusion being positioned at the interface of said head member and said skirt member.

16. The two piece unitary piston of claim 1 wherein said piston cooling gallery includes a coolant inlet and a coolant outlet.

17. The two piece unitary piston of claim 1 wherein said welding process joining said interface formed by said upper inner support surface being aligned with said support surface and said interface formed by said upper outer support surface being aligned with said bottom surface being a laser weld.

18. The two piece unitary piston of claim 1 wherein said welding process joining said interface formed by said upper inner support surface being aligned with said support surface and said interface formed by said upper outer support surface being aligned with said bottom surface being a CO2 laser weld.

19. The two piece unitary piston of claim 1 wherein said welding process joining said interface formed by said upper inner support surface being aligned with said support surface and said interface formed by said upper outer support surface being aligned with said bottom surface being a electron beam weld.

20. The two piece unitary piston of claim 1 wherein said welding process joining said interface formed by said upper inner support surface being aligned with said support surface and said interface formed by said upper outer support surface being aligned with said bottom surface being an inertia weld.

21. The two piece unitary piston of claim 1 wherein said head member further including a crown portion having a ring band portion connected thereto.

22. The two piece unitary piston of claim 1 wherein said skirt member further including a ring band portion.

23. A two piece unitary piston, said two piece unitary piston comprising:

a head member being made of a material having a preestablished material strength, having a bottom surface and an inner support portion defining a support surface;

a skirt member being made of a material having a preestablished material strength being substantially the same as the preestablished material strength of said head member, having an upper outer support surface aligned with the bottom surface forming an interface and an inner support portion defining an upper inner support surface forming an interface and each of said interfaces being in contacting and supporting relationship with said bottom surface and said support surface of said head member respectively;

said interface formed by said upper inner support surface being aligned with said support surface being joined by a welding process;

said interface formed by said upper outer support surface being aligned with said bottom surface being joined by said welding process;

a piston cooling gallery being formed by said upper inner support surface and said support surface interface and said upper outer support surface being aligned with said bottom surface interface; and said head member and said skirt member are formed as a single unit and being separated prior to said welding process.

24. The two piece unitary piston of claim 23 (1) wherein said interface formed by said upper inner support surface being aligned with said support surface having a preestablished cross sectional surface area and said interface formed by said upper outer support surface being aligned with said bottom surface having a preestablished cross sectional surface area and each of said preestablished surface areas being a different cross sectional surface area.

25. A method of making a two piece unitary piston, said method of making comprising the steps of:

forming a head member of a material having a preestablished strength, said forming defining an axis, a bottom surface and a support surface being spaced from said bottom surface;

forming a skirt member of a material having a preestablished strength being substantially the same as the preestablished material of said head member, said forming defining an axis, an upper outer support surface and an upper inner support surface being spaced from said upper outer support surface;

forming at least one of said bottom surface and said upper outer support surface, and said support surface and said upper inner support surface at an angle other than 90 degrees to said axis;

positioning said bottom surface of said head member in contacting and supporting relationship with said upper outer support surface of said skirt member;

positioning said support surface of said head member in contacting and supporting relationship with said upper inner support surface of said skirt member;

welding said interface of said bottom surface and said upper outer support surface;

welding said interface of said support surface and said upper inner support surface; and combining fixedly said head member and said skirt member forming a piston cooling gallery.

26. The method of making said two piece unitary piston of claim 25 wherein said step of forming said head member including a forging operation.

27. The method of making said two piece unitary piston of claim 25 wherein said step of forming said skirt member including a forging operation.

28. The method of making said two piece unitary piston of claim 25 wherein said step of forming said skirt member including a casting.

29. The method of making said two piece unitary piston of claim 25 wherein said steps of welding said interface of said bottom surface and said upper outer support surface and welding said interface of said support surface and said upper inner support surface including the same welding process.

30. The method of making said two piece unitary piston of claim 29 wherein said step of welding including said welding process including a laser welding process.

31. The method of making said two piece unitary piston of claim 30 wherein said step of welding including said laser welding process including a CO2 laser welding process.

32. The method of making said two piece unitary piston of claim 29 wherein said step of welding including said welding process including an electron beam welding process.

33. The method of making said two piece unitary piston of claim 29 wherein said step of welding including said welding process including a friction welding process.

34. The method of making said two piece unitary piston of claim 25 wherein at least one of said steps of welding said interface of said bottom surface and said upper outer support surface and said step of welding said interface of said support surface and said upper inner support surface including a protrusion having a lip attached thereto.

35. The method of making said two piece unitary piston of claim 25 wherein each of said steps of forming a head member and forming a skirt member includes a premachining operation.

36. The method of making said two piece unitary piston of claim 25 wherein said steps of forming said head member and said skirt member being formed as a single unit and being separated prior to said welding of said interfaces.

37. The method of making said two piece unitary piston of claim 25 wherein said step of forming said head member further including a head member cooling gallery.

38. The method of making said two piece unitary piston of claim 25 wherein said step of forming said skirt member further including a skirt member cooling gallery.

39. A method of making a two piece unitary piston, said method of making comprising the steps of:

forming a head member of a material having a preestablished strength, said forming defining a bottom surface and a support surface being spaced from said bottom surface;

forming a skirt member of a material having a preestablished strength being substantially the same as the preestablished material of said head member, said forming defining an upper outer support surface and an upper inner support surface being spaced from said upper outer support surface;

forming a protrusion, said protrusion extending from an interface of said head member and said skirt member;

positioning said bottom surface of said head member in contacting and supporting relationship with said upper outer support surface of said skirt member;

positioning said support surface of said head member in contacting and supporting relationship with said upper inner support surface of said skirt member;

welding said interface of said bottom surface and said upper outer support surface;

welding said interface of said support surface and said upper inner support surface; and combining fixedly said head member and said skirt member forming a piston cooling gallery.

40. An engine including a block having a cylinder therein, said engine comprising:

a head member being made of a material having a preestablished material strength, said head member having a bottom surface and an inner support portion being spaced from said bottom surface forming a head member;

a skirt member being made of a material having a preestablished material strength being substantially the same as said preestablished material strength of said head member, said skirt member having an upper outer support surface being aligned with said bottom surface and forming an interface, said skirt member further having an upper inner support surface being aligned with said inner support portion and forming an interface, each of said interface being in contacting and supporting relationship with said bottom surface and said upper outer support surface, and said inner support portion and said upper inner support surface respectfully;

at least one of said interface of said bottom surface and said upper outer support surface and said interface of said support surface and said upper inner support surface including a protrusion;

a weld fixedly attaching each of said interfaces, and a piston cooling gallery being formed within at least one of said piston member and said skirt member.

41. The engine of claim 40 wherein said protrusion includes a lip.

42. The engine of claim 40 wherein said head member and said skirt member being formed as a single unit and being separated prior to said welding of said interface.

* * * * *